United States Patent [19]

Conzemius

[11] Patent Number: 4,818,862

[45] Date of Patent: Apr. 4, 1989

[54] CHARACTERIZATION OF COMPOUNDS BY TIME-OF-FLIGHT MEASUREMENT UTILIZING RANDOM FAST IONS

[75] Inventor: Robert J. Conzemius, Ames, Iowa

[73] Assignee: Iowa State University Research Foundation, Inc., Ames, Iowa

[21] Appl. No.: 110,856

[22] Filed: Oct. 21, 1987

[51] Int. Cl.[4] ..... H01J 49/40

[52] U.S. Cl. ..... 250/287; 250/281; 250/282

[58] Field of Search ..... 250/287, 281, 282

[56] References Cited

U.S. PATENT DOCUMENTS

| | | | |
|---|---|---|---|
| 3,767,914 | 10/1973 | Mueller et al. | 250/287 |
| 4,072,862 | 2/1978 | Mamyrin et al. | 250/286 |
| 4,136,280 | 1/1979 | Hunt et al. | 250/242 |
| 4,439,395 | 3/1984 | Kim | 376/130 |
| 4,458,149 | 7/1984 | Muga | 250/287 |
| 4,472,631 | 9/1984 | Enke et al. | 250/281 |
| 4,611,118 | 9/1986 | Managadze | 250/287 |

OTHER PUBLICATIONS

Yost and Enke, *An Added Dimension for Structure Elucidation Through Triple Quadruple MS,* American Laboratory (Jun. 1981) pp. 88–95.

Wood, Edwards and Steuer, *Time-of Flight Energy Spectrometer for Positive Ions,* Rev. Sci. Instrum., vol. 47, No. 12 (Dec. 1976) pp. 1471–1474.

Negra and Le Beyec, *A* $^{252}$Cf Time-of-Flight Mass Spectrometer with Improved Mass Resolution, International Journal of Mass Spectrometry and Ion Processes, vol. 61 (1984) pp. 21–29.

*Primary Examiner*—Bruce C. Anderson
*Assistant Examiner*—Jack I. Berman
*Attorney, Agent, or Firm*—Haverstock, Garrett and Roberts

[57] ABSTRACT

An apparatus for characterizing the mass of sample and daughter particles, comprising a source for providing sample ions; a fragmentation region wherein a fraction of the sample ions may fragment to produce daughter ion particles; an electrostatic field region held at a voltage level sufficient to effect ion-neutral separation and ion-ion separation of fragments from the same sample ion and to separate ions of different kinetic energy; a detector system for measuring the relative arrival times of particles; and processing means operatively connected to the detector system to receive and store the relative arrival times and operable to compare the arrival times with times detected at the detector when the electrostatic field region is held at a different voltage level and to thereafter characterize the particles. Sample and daughter particles are characterized with respect to mass and other characteristics by detecting at a particle detector the relative time of arrival for fragments of a sample ion at two different electrostatic voltage levels. The two sets of particle arrival times are used in conjunction with the known altered voltage levels to mathematically characterize the sample and daughter fragments. In an alternative embodiment the present invention may be used as a detector for a conventional mass spectrometer. In this embodiment, conventional mass spectrometry analysis is enhanced due to further mass resolving of the detected ions.

29 Claims, 3 Drawing Sheets

Illustration of Data Flow With a Null Period Required Before Delta Times are Recorded and Stored.

Illustration of Data Flow With Continuous Recording of Time of Arrival for All Particles Activating The Detector.

*Fig. 5* Simplified Example of Information Obtained With Sample in Table I

| ENTRY NO. | COMPOUND | FRAGMENT SITE |
|---|---|---|
| 1 | X | 0 |
| 2 | Y | 0 |
| 3 | X | 1 |
| 4 | X | 1 |
| 5 | X | 2 |
| 6 | X | 2 |
| 7 | X | 3 |
| 8 | X | 3 |
| 9 | X | 4 |
| 10 | X | 4 |
| 11 | Y | 1 |
| 12 | Y | 1 |
| 13 | Y | 2 |
| 14 | Y | 2 |
| 15 | Y | 3 |
| 16 | Y | 3 |

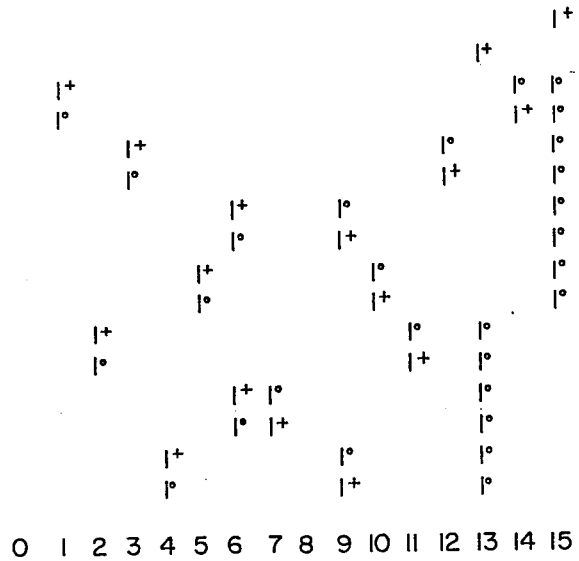

Individual Mass Assignments for possible Sample Ions. Information Obtained with Invention.

*Fig. 5a*

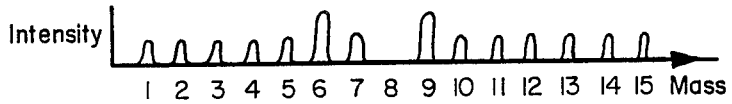

Mass Information with Ordinary MS. Fourteen Masses Observed All Together.

*Fig. 5b*

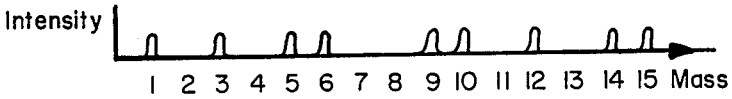

Mass Information Obtained with MS/MS at Precursor =15.

*Fig. 5c*

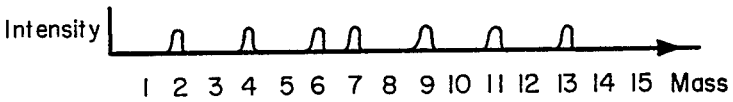

Mass Information Obtained with MS/MS at Precursor = 13.

*Fig. 5d*

CHARACTERIZATION OF COMPOUNDS BY TIME-OF-FLIGHT MEASUREMENT UTILIZING RANDOM FAST IONS invention was made with Government support under Contract No. W-7405-Eng 82 awarded by the Department of Energy. The Government has certain rights in the invention.

BACKGROUND OF THE INVENTION

The present invention relates to mass spectrometry apparatus and methods for obtaining information of molecular weight and structural composition of compounds, such as has been previously obtained by mass spectrometers generally and more specifically by tandem mass spectrometers. The invention can also be used as a detector in conventional mass spectrometers to further mass resolve detected ions.

In simple mass spectrometers, ions are produced from solids, liquids, or gases by some ionizing event such as electron beam bombardment of a gas. The ions are detected after mass separation by various techniques such as magnetic analyzers, quadrupole or monopole r-f field mass filters, time-of-flight separators, Fourier transform mass separators, etc. The detected ions can be elemental or molecular ions characteristic of the specimen, fragment ion products caused by the ionizing event, or fragment ions due to decomposition of a precursor ion which are produced either in the ion source or along the ion path to the detector.

More recently, mass spectrometers have been placed in tandem in which the first spectrometer mass separates an ion species which is caused to fragment or dissociate, such as by metastable decomposition, collision induced dissociation (CID) or collisionally activated dissociation (CAD), into lower mass product particles (daughters) of which some are ionic and some are neutral. The ion daughters are subsequently mass separated to give a daughter ion spectrum of the products of fragmentation originating from precursor ion species. This tandem construction is known as MS/MS. Such a combination of mass spectrometers allows analysis of specific daughter ions which are unique to a specific precursor ion in the presence of mixtures or with complex, high mass compounds for which simple mass spectrometric separation would allow contributions to the ion signal from other interfering ions or fragments thus causing great difficulty and confusion for interpretation. MS/MS thus greatly increases the information gathering capability of simple mass spectrometers.

Although MS/MS has many benefits and uses, inherent disadvantages exist. For example, such devices make inefficient use of the produced ions in that many of the ions are destroyed due to system losses rather than being detected. Additionally, all ion particles which are not selected by the first mass analyzer are discarded thus causing loss of data as well as hindering unique ion characterization as will become apparent in this invention. Other disadvantages include difficulty in quantifying the ensuing data, since the numbers of each type of fragmentation event is not known exactly, and destructive losses to the specimen due to the requirement for relatively large ion currents.

Another form of mass spectrometry is known as time-of-flight mass spectromety. In a time-of-flight mass spectrometer ions are produced and then accelerated, either in a constant-energy or a constant-momentum mode. In either case, lighter (lower mass) ions are accelerated to higher velocities than the heavier ions. The ions then enter a drift region or flight tube which establishes an ion path length, and which is followed by an ion detector. In the drift region, the ions separate along the ion path as a function of their velocity and thus arrive at the detector at different times depending upon their velocities, and therefore, depending upon their mass.

To permit measurement of flight time, ions in a time-of-flight mass spectrometer are bunched, typically by means of a pulsed source, and all ions of a given bunch enter the drift region at substantially the same position and time. By correlating ion pulsing or bunching with arrival time of various ions at the detector, the time-of-flight of each individual ion or group of identical-mass ions can be determined. Ion velocity follows from the simple relationship:

$$(\text{Velocity}) = (\text{Path Length})/(\text{Time-Of-Flight}).$$

From velocity, ion mass can be calculated, taking into account the characteristics of the ion accelerator.

A fundamental disadvantage of conventional time-of-flight mass spectrometry is the expense of equipment used for pulsing of the ion source and the need to know the time of ion creation.

SUMMARY OF THE INVENTION

Referring now to FIG. 1, there is shown a generalized representation of the present inventive method and apparatus 10. Briefly, the specimen to be analyzed 12 is excited through ion bombardment 14 or other means to produce at least one ionized particle which is indicative of the elemental structure of the specimen 12. The ionized particle will hereinafter be referred to as a sample ion. The sample ion is passed through an ion accelerator region 18 to provide the sample ion with a substantially constant relationship between mass and velocity. In some instances, more than one sample ion will be produced by the ionization event. When this occurs, it is desirous to provide a drift region 20 of sufficient length following the ion acceleration region to allow sample or principle ions having different mass to achieve a desired separation in time before entering a following fragmentation region 22.

Within the fragmentation region, it is desirous that a fraction such as 20 percent of the sample ions entering are induced to fragment. In FIG. 1 only one sample ion is shown as being produced and subsequently passed into the fragmentation region. In some cases the sample ion will not fragment but may become neutralized, more highly charged or may simply pass unaffected. The fragmented daughters and/or unfragmented neutral or ionized samples are thereafter passed into an accelerating or decelerating region 24 to effect separation of neutral and ion fragments, created from the same precursor ions, and to separate sample ions and particles of different kinetic energy.

In most instances, the accelerating or decelerating region comprises a drift region containing an electrostatic field held at the final acceleration or deceleration voltage to actually effect the ion-neutral separation and ion-ion separation before the particles are detected. As shown in FIG. 1 the sample ion 16 fragmented into daughter neutral **16*a* and daughter ion 16*b*. The electrostatic field region causes the ion to decelerate. The neutral particle 16*b* however, freely travels through the charged field and will reach the detector 26 first. When the electrostatic field region has an opposite polarity to the polarity used to decelerate ions, the ions will be accelerated ahead of the neutral particles and will arrive at the detector first. In some cases, due to detector system limitations, it is necessary to offset or counteract the accelerating or decelerating potential of the electrostatic field before the particles are detected or the electrostatic field potential will affect the electrostatic requirements of the detector. In one embodiment, this is achieved by including a decelerating or accelerating region (not shown) following the electrostatic drift region. This region would, of course, not be necessary when the detector input is held at the same electrostatic level as the electrostatic region 24**.

The detector system employed with the present invention is designed in one embodiment to become activated upon the arrival of a first particle and thereafter clock and store the sequential arrival times of the subsequently arriving particles relative to the first particle arrival time. The detected $\Delta T$ arrival times are plotted in a histogram.

Parent sample ions of a given mass generally fragment in preferred bonds or sites. Thus, for example, a sample ion of mass $M_X$ may fragment repeatedly into an ionized daughter component of Mass $M_1$ and a neutral daughter component of mass $M_2$. These daughter components will pass through the electrostatic field and become separated in time based upon the mass of the ionized particle. Thus, the neutral and ionized daughter particles originating from a sample of mass Mx will arrive at the detector with a repeatable time shift t relative to one another. Likewise, a sample of mass $M_Y$ could, for example, fragment into two or more ion-ion particles, ion-neutral particles or not fragment at all. In any event, the arriving particles will arrive at the detector in distinct and repeatable time shifts relative to one another. By maintaining the electrostatic field region at a known length and potential and by repeatedly creating sample ions, it is possible to chart or graph all the various delta time possibilities in histogram form. By altering the electrostatic field potential and thereafter repeating the ionization to detection sequence, a new set of distinct delta times can be obtained and plotted. The new histogram plot can be compared with the first to determine definite patterns and correlations between the two. For example, the fragmented daughter particles of the sample ion of mass $M_X$ mentioned earlier herein, which we stated for purposes of illustration as fragmenting into an ionized daughter component of mass $M_1$ and a neutral component of mass $M_2$, may arrive at the detector with a delta time $\Delta T_1$ when the electrostatic field is set to a potential $G_1$. However, those same daughter particles may arrive at the detector with time differential $\Delta T_2$ when the electrostatic field is set to a potential $G_2$. In accordance with the present invention, the unknown sample mass and daughter particle masses can be calculated mathematically from these repeatable correlations and the known G field settings. Storage of the sample and daughter mass arrival times from individual fragmentation or from simultaneous generation at the sample source allows later recall of the unique ions and fragments thus allowing unique identification of structural facts of the precursor ion or of the simultaneous generation very likely generated from the same immediate region of the sample.

In light of the foregoing comments, it will be recognized that a principal object of the present invention is to provide apparatus and methods to remove the obscurity currently present in tandem mass spectrometry by detecting uniquely individual principal ions and their associated and unique daughter products and to store this information without loss of any significant information or loss of any significant principal ions or daughter products.

It is a further object of the present invention to greatly simplify time-of-flight mass spectrometry by eliminating the requirement of the knowledge of time-zero, the time of production of the principal ion(s) from the specimen of interest.

It is another object of the invention to eliminate the need to construct a mass spectrum to abstract complete information concerning the mass and elemental structure of the principal ion(s) as well as the mass of the individual ions and neutral daughter(s) in illucidating the structure of the specimen.

It is another object of this invention to allow complete recall of each individual primary ion created and of the particular mass of each individual fragmentation event.

It is another object of this invention to allow the maximum resolution to be achieved by time-of-flight mass spectrometry by recording specifically the time of arrival of each individual particle(s).

It is another object of this invention to permit very high sensitivity to be achieved by providing apparatus and technique which detects the mass of every ion created and the unique mass of the daughter ion(s) and neutral subsequently created by fragmentation of ions created from the specimen.

It is another object of this invention to remove obscurity in mass spectra by allowing the complete structure illucidation to be accomplished in the presence of a mixture in the sample and in fact to illucidate the structure of all the components of the specimen simultaneously.

These and other objects and advantages of the present invention will become apparent to those skilled in the art after considering the following detailed specification, which discloses a preferred embodiment in conjunction with the accompanying drawings wherein:

FIG. **5*a*** is an illustration of the mass and structural resolving capabilities of the present invention for a hypothetical specimen containing two hypothetical compounds;

FIG. **5*b* is an illustration of the mass and structural resolving capabilities of a conventional mass spectrometer for the same hypothetical specimen of FIG. 5*a***;

FIG. **5*c* is an illustration of the mass and structural resolving capabilities of a MS/MS at precursor 15 for the same hypothetical specimen of FIG. 5*a***; and, FIG. 5*d* is a illustration of the mass and structural resolving capabilities of a MS/MS of precursor 13 for the same hypothetical specimen of FIG. 5*a*.

DETAILED DESCRIPTION OF THE PREFERRED EMBODIMENT

Figure 1:
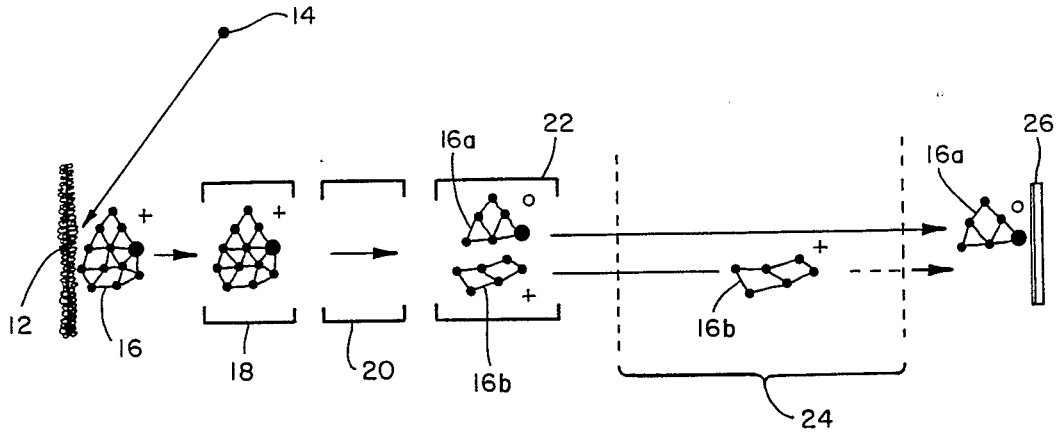
FIG. 1 is a generalized illustration of the major components of the present invention.
Figure 2:
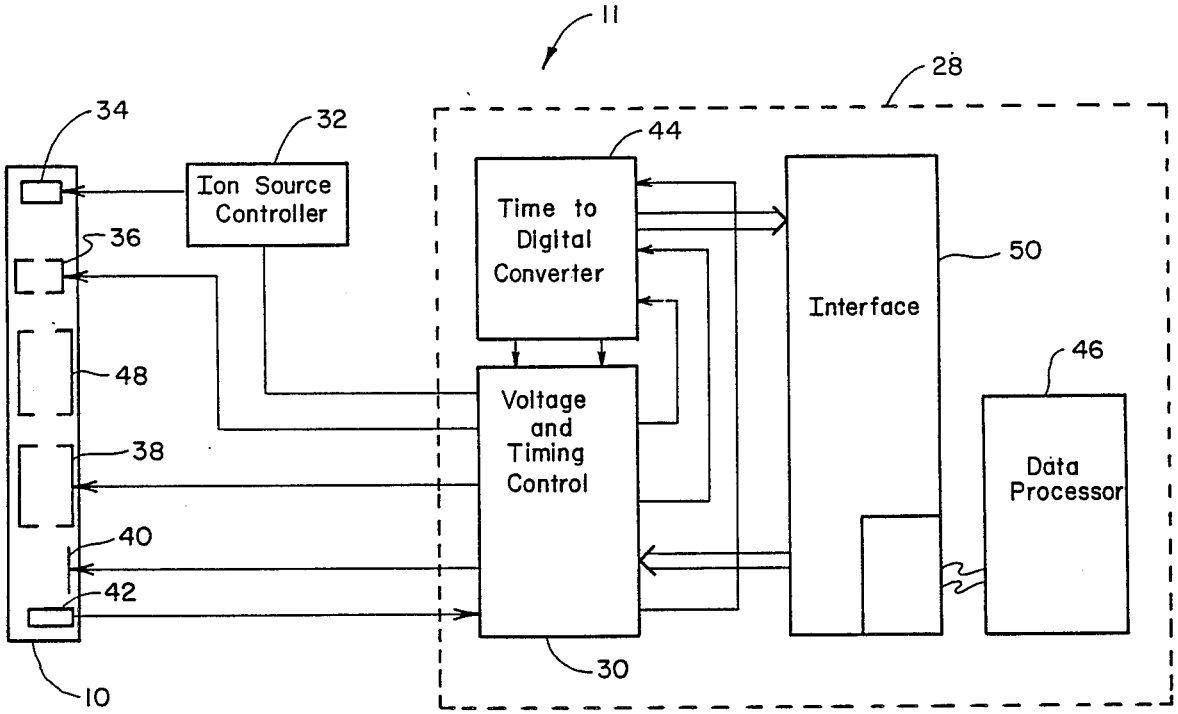
FIG. 2 is an illustration, in block diagram form, depicting in greater detail a preferred embodiment of the present invention.

In FIG. 2, the method and apparatus for characterization of compounds by time-of-flight measurements utilizing random fast ion signals 11 in accordance with the present invention is shown in highly schematic block diagram form. However, as will be appreciated by those skilled in the art, its essential elements comprise well-known commercially available devices, and as such need not be described in detail herein. As mentioned earlier herein, one of the advantages of the subject invention is that it may be used alone for the rapid and accurate determination of the structure of organic compounds or it could be easily fitted to a conventional mass spectrometer as a relatively low cost detector for the ions which have been previously mass resolved. This coupling would effectively increase the informing power of conventional prior art mass spectrometers by allowing the continuous beam output thereof to be further mass resolved into accurate mass fractions.

Now referring to the FIG. 2 embodiment in greater detail, an embodiment of the present invention operating under computer control from processing control means 28 is shown. Typically, processing and control means 28 would include voltage supply/control and timing means 30 which would supply the appropriate supply voltage to various components of the mass spectrometer 10 such as to ion source controller 32 which controls the average ion intensity of the ions produced from the source 34. Such means would also control the voltage levels of the ion accelerators/decelerators 36 and 38, the ion deflection voltage level of an optional ion deflector 40, and the timing of particle detector 42. In the embodiment of FIG. 2, the detected delta times are converted to digital form by time to digital converter 44 and processed in accordance with the present invention by processor/controller 46. Block 50 indicates a standard interface. Sample ions are provided by ion source 34 such as by electron bombardment of a gas, electrospray ionization of a liquid, particle bombardment of a solid, or simple field desorption of a solid, or any other suitable means which keeps within the requirements of the present inventive concept. Typical component parts for the processing and control means 28 of the FIG. 2 embodiment may comprise ,for example, a NSI model 1000 voltage supply/control and timing means 30; a LeCroy model 4208 Time-to-Digital Converter 44; a CAMAC high speed data transfer interface 50; and a Hewlett Packard Vectra processor and controller 46.

It should be quickly appreciated by those skilled in the art that unlike previous time-of-flight mass spectrometers, where the ions are produced in a short burst in which the number of ions would be maximized and the time range of the burst shortened until space charge effects or other technological difficulties would not allow further improvement in the ion source for the time-of-flight, the ions of the present device may be produced in a random manner with neither the requirement for forming a burst nor for determining time zero, the time the ions were created. However, because the ion signal is purposely set low, an ionizing technique that produces large ion signals in a burst can still be made to work but is less appropriate than an ionizing technique causing one or only a very few ions to be created. Thus, instruments allowing the burst to be created randomly with fission products, e.g., plasma desorption ion source, with subsequent detection of time zero of the event by detecting projectiles caused by each fissure, or a random source of ions where the instrumentation detects secondary electrons created simultaneously with the creation time of the principal ions perform unnecessary task and inherently complicate and limit the ion source. This versatility in possible ion sources is a significant benefit when considering that the production of high ion currents for long periods of time leads to detrimental effects such as degradation of the sample with time. Also, the ionization mechanism can cause accumulated specimen deterioration due to the cause of ionization or due to limited quantities of sample.

After production, the sample ions are given a uniform kinetic energy by acceleration through a fixed electric field 36. It should be apparent to those skilled in the art that the accelerating field within 36 is schematically shown separated from the source of ions 34. However, the usual case is for the accelerating field to start within the source and proceed immediately through region 36 and this is intended to be covered by the present disclosure. Generally, two classes of ion acceleration are known: constant-energy acceleration and constant-momentum acceleration. Both constant energy ($\frac{1}{2}mv^2$) and constant-momentum (mv) modes of acceleration provide ions having a constant relationship between mass (m) and velocity (v). Either may be employed in the practice of the invention. Following ion acceleration, the sample ions are traveling at a velocity which is an inverse function of their mass, with the result that the total time of travel through the instrument is related to the sample ion mass.

After acceleration, the primary ion beam is required to dissociate into daughter products of which one or more daughters may contain an ionic charge and one or more may be electrically neutral. The fragmentation may occur either by collisionally-activated dissociation, or by metastable decomposition. Various means may be employed to facilitate unimolecular decomposition, such as photo-dissociation, electron exitation, and others. Collisionally-activated dissociation may be accomplished by a collision cell. The fragmentation region may comprise a means for injecting energy into the sample ion such as with a laser beam to cause fragmentation of the sample ions. The present invention does not require that each principal ion decompose or sample ion separate; however, a fraction of the total possible decomposition routes should do so.

In order to reduce errors in the calculation of mass and other characterizations, it is necessary that fragmentation occur without any substantial change in velocity. In other words, individual daughter particles should maintain approximately the same velocity as the particular sample ions producing them.

Following the dissociation region 48, a fraction of the daughter products and non-dissociated sample ions should enter an electrostatic "G" field region 38 where acceleration or deceleration of ionized daughter particles occurs. This field region should be of length and polarity so as to accelerate or decelerate the ion away from the neutral particle and thus create a delta time between the fragments. This length and polarity varies with the timing of the sample ion production and the data handling requirements and capabilities of particle detector 42 as well as the desired measurement accuracy. For design purposes and as a general rule of thumb, the average time between the principal ions caused by a different ionizing event in the source, and which are subsequently fragmented into daughter products which enter the G field, should be greater than a typical time for the G field to separate spatially and thus in time the ion and neutral pair due to speeding or slowing of the ions.

Following the electrostatic G field region is a particle detector 42 which may comprise any suitable type, and typically is the type used for time-of-flight spectroscopy. The detector system is responsive to the arrival of the first particle, whether a neutral or ion, to detect and determine the subsequent particle arrival times relative to the first. After detection of the particles and subsequent determination of the particle delta times, it is necessary to determine the correlations and patterns of delta times which can lead to characterization of the sample ion. Although this data gathering and manipulation process can be performed manually, in a preferred embodiment of the present invention the system is operated under computer control by computer processing and control means shown generally as dotted 28 area of FIG. 2.

Figure 3:
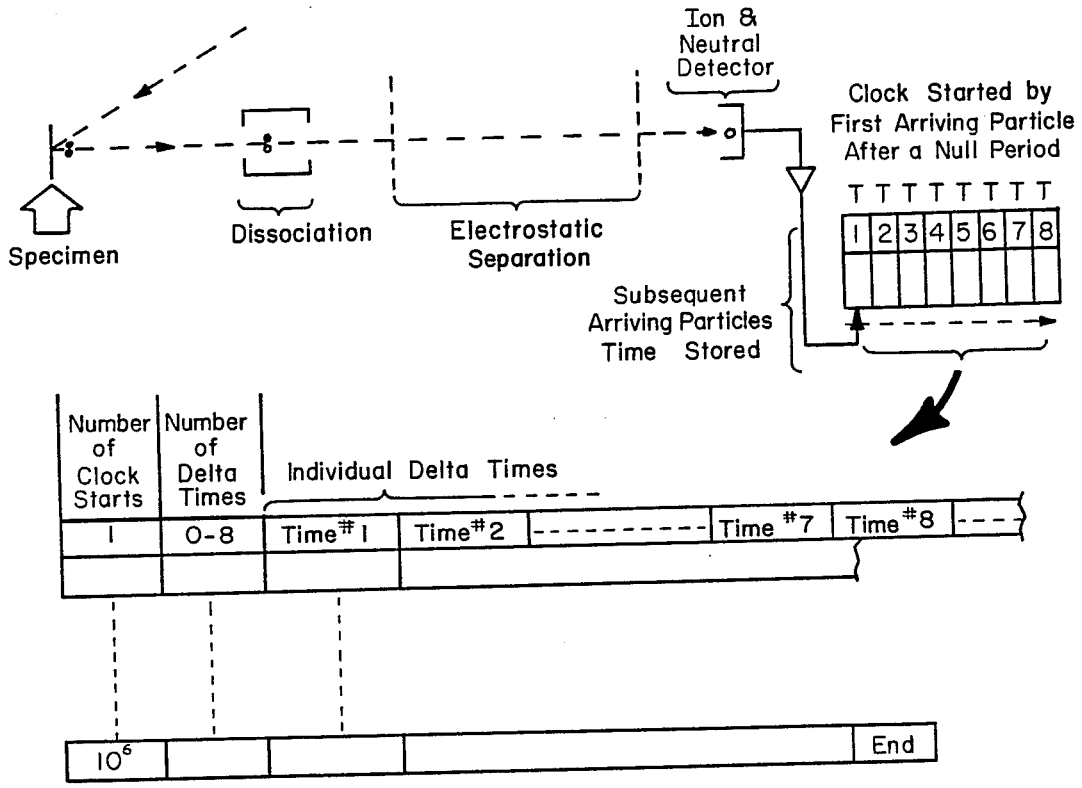
FIG. 3 is an illustration of the preferred data collection method for the present invention wherein a null period is required.

There are various ways in keeping with the spirit of the present invention to collect the data and effect processing thereof. In one mode of operation, however, the particle detector utilizes hardware or is under computer control to gather data in accordance with the sequence of events shown in FIG. 3. Once the data is collected, processing, either manually or under computer control, may be effected utilizing the mathematical equations which will be discussed hereinafter to determine mass assignment for any sample or daughter fragment based solely on the variation of a known electrostatic field setting and the detected delta times.

Again, referring to FIG. 3, the particles arriving at the detector may be daughter neutral, daughter ion, principal ion that was unfragmented or that was neutralized. The timing of the particle detector is such that a preset laspe time (PLT) is initiated in which no particles are detected. After this time which is approximately one millisecond, the detector is activated by the first arriving particle. Subsequent particles create stop signals causing a recording of the elapsed time since the clock was first activated by the first arriving particle. The delta times of all particles arriving within a second present time called herein the maximum allowed fragments arrival time (MAFAT) have their delta time of arrival recorded. After the MAFAT is exceeded, the recorded times are stored, the clock is reset to zero and armed to be reinitiated after another PLT. As discussed earlier herein, the timing of sample particle production is such that each ionizing event is detected at the detector within the maximum allowed fragments arrival time. The total number of such cycles of singular molecular fragmentation events is monitored and the cycle allowed to be repeated until the desired number of fragmentations is achieved. This mode of operation greatly relieves some of the computational burden placed upon the processing system which would otherwise have to search for differences in arrival times which are made continuously. By separating the particles at the detector with respect to the ionizing event which created them, the processing is simplified. This is the first part of the present method labeled herein as run No. 1. The data from run No. 1 are stored and herein labeled delta times No. 1. These delta times are subsequently plotted out into a frequency histogram where the patterns of delta times are labeled herein histogram #1. The second half of the data gathering procedure of the present method can proceed immediately after run No. 1 and is called herein experiment No. 2. In run No. 2, the electrostatic G field is set to a new value which has been chosen to provide a new set to delta times (i.e., delta times No. 2). This second set of delta times are plotted and result in patterns which are labeled herein as histogram No. 2.

Delta times appear in the histograms from both runs in definite patterns due to a particular principal ion fragmentation giving unique ion and neutral daughters which have been repeated during the experiment. The delta times also result in patterns in the histograms due to principal ions arriving at the detector which were created simultaneously at the specimen (e.g., as from a solid specimen bombarded with a single ion or fast atom). The individual delta times within a pattern will not be identical for the same unique ion-ion or ion-neutral pair due to slightly different flight paths, differing energies of dissociation or of ejection from the specimen, or due to translational energy loss in collision with a target gas. However, the patterns are identifiable and the definite shifts between run No. 1 and run No. 2 allow an accurate time shift to be measured. This is especially simplified and made accurate since the individual times creating the patterns are stored in the computer for data manipulations and comparison of time shifts. Accuracy is also gained when more than two particles are identified as being initiated from the same principal event at the specimen and/or from the region of dissociation. The time shifts between run No. 1 and run No. 2 allow for computation of mass as will be shown in the following description of mathematical relationships.

Generally, in operation, the ions are created at the source 34 and accelerated through a voltage field 36. The ions traversing the voltage field will be called principal ions and the subscript p will refer to these ions. The principal ions may be fragments of other principal ions or due to other components of the specimen at the source 34. The results of the computations for the present invention will be a determination of the mass of the principal ions as well as the mass of the daughter fragments of the principal ions. The principal ions enter a dissociation region 48 where sufficient energy is input to the ions to cause fragmentation. The result of fragmentation may simply be a neutralized principal ion, a higher charged principal ion, or the creation of fragments which may be charged (daughter ions) or neutral (daughter neutrals). The subscript notation will denote the principal (e.g., $m_{PB}$ is the mass of the principal ion for daughter fragment B etc.) or the daughter products (e.g., $v_B$ is the velocity of daughter component B).

The kinetic energy of any particular principal ion will be $$KE=(\tfrac{1}{2})*m_p*v_p \qquad (1)$$

Where

KE=kinetic energy $m_p$=mass of the principal ion in am$\mu$ $v_p$=velocity of the principal ion in cm/sec.

The kinetic energy is obtained from the acceleration of the charge (q) on the ion through the accelerating field. Thus, $$KE = UO*q_p = \frac{k}{2}*m_p*v_p^2 \quad (2)$$

where

UO=the voltage on the electric field (volts) in the voltage field region 36 of FIG. 2

$g_p$=the charge on mass $m_p$ k=the constant needed for conversion of units.

Particles neutralized or fragmented in the dissociation region 48 retain the velocity component of the precursor. The small energy due to dissociation and any loss of translational energy is ignored since they simply cause a small spread in the velocity component for different fragmentations but the main velocity component remains that of the precursor. Thus, for the example where $m_p$ fragments to $m_{AN}$ and $m_{B1}$ (i.e., P→A°+B+) the velocity after fragmentation is $$v_p = v_{AN} = v_{B1} \quad (3)$$

(i.e., the velocity of the neutral fragment A equals the velocity of the ion component B which equals the velocity of the sample). Thus, the neutral particles created in dissociation region 48 will thereafter traverse the remaining length of region 38 as if the electrical field on the electrostatic region 38 did not exist and the time will be:

$$t_{AN} = \frac{d}{v_{AN}} \quad (4)$$

where d=the distance of flight where velocity AN is valid $t_{AN}$=the time for the neutral component to move through distance d.

Any changes in the electrostatic field region 38 in subsequent runs can be ignored since the time differences between neutral components will not change between the first run with field setting G1 and the second run with field setting G2 of the present method. The time differences created between ions and neutrals as they traverse the electrostatic G regions when they have a common precursor are vital to the present invention. Both the ion and neutral daughters will enter the electrostatic G field region 38 at approximately the same time. The time for neutral daughter to traverse electrostatic region 38 is:

$$t_{AG} = \frac{d_G}{v_{AN}} \quad (5)$$

Since $v_{AN}$ equals $v_{PA}$ or $v_p$, combining equations 2 and 5 gives:

$$t_{AG} = \frac{d_G}{\left(\frac{2*UO*q_p}{k*m_{PA}}\right)^{\frac{1}{2}}} \quad (6)$$

The time for ion fragments to traverse electrostatic region 38 will depend on the voltage field on region 38, the mass fraction of the ion relative to the precursor principal ion, and the velocity of the principal ion. The kinetic energy of ion daughter fragment B just prior to entering electrostatic region 38 is:

$$KE_B = \frac{1}{2}*m_B*v_{PB}^2 \quad (7)$$

(i.e., the velocity of the sample is retained). Putting the KE into units compatible with voltage and charge units we obtain:

$$KE_B = \frac{k}{2}*m_B*v_{PB}^2 \quad (8)$$

where k is the same as in equation 2. Now we can express the kinetic energy of fragment B in region G as the starting KE as expressed in equation 8 minus the electrostatic field in G1 working on charge $g_B$, Thus, $$KE_{BG} = \frac{k}{2}*m_B*v_{PB}^2 - U_{G1}*g_B \quad (9)$$

where $U_{G1}$ is the voltage on electrostatic region 38 for run No. 1 and $g_B$ is the charge of fragment B. Assuming the ion charge to be 1, we can also express the velocity of the ion fragment in electrostatic region 38 ($v_{BG}$) in the definition of its kinetic energy as $$KE_{BG} = \frac{k}{2}*m_B*v_{BG}^2 \quad (10)$$

and then $$v_{BG} = [KE_{BG}*2/(k*m_B)]^{\frac{1}{2}} \quad (11)$$

Combining equations 9 and 11 yields $$V_{BG} = \left(\frac{2}{k*m_B}\right)^{\frac{1}{2}}*\left(\frac{k}{2}*m_B*v_{PB}^2 - U_{G1}*g_B\right)^{\frac{1}{2}} \quad (12)$$

Combining equations 12 with 2 (i.e., $v_{PB} = v_p$ *and* $m_{PB} = m_p$) *gives*

$$v_{BG} = \left(\frac{2}{k*m_B}\right)^{\frac{1}{2}}*\left(\frac{k}{2}*m_B*\frac{2*UO*g_p}{k*m_{PB}} - U_{G1}*g_B\right)^{\frac{1}{2}} \quad (13)$$

or, simplifying, $$v_{BG} = \left(\frac{2}{k*m_B}\right)^{\frac{1}{2}}*\left(\frac{m_B*UO*g_p}{m_{PB}} - U_{G1}*g_B\right)^{\frac{1}{2}} \quad (14)$$

Thus, the time for B to traverse region 38 through its length $d_G$ is $$t_{BG} = \frac{d_G*k^{\frac{1}{2}}*m_B^{\frac{1}{2}}}{2^{\frac{1}{2}}} / \left(\frac{m_B*UO*g_p}{m_{PB}} - U_{G1}*g_B\right)^{\frac{1}{2}} \quad (15)$$

The time difference ($\Delta t_{AB1}$) between the neutral fragment A, and the ion fragment B in electrostatic region 38 is $t_{BG} - t_{AG}$ thus from equations 6 and 15 we get $$\Delta t_{AB1} = \quad (16)$$

-continued $$\frac{d_G{*}k^{\frac{1}{2}}{*}m_B^{\frac{1}{2}}}{2^{\frac{1}{2}}} / \left[\frac{m_B{*}UO{*}g_p}{m_{PB}} - U_{G1}{*}g_B\right]^{\frac{1}{2}} - d_G\left(\frac{k{*}m_{PA}}{2{*}UO{*}g_p}\right)^{\frac{1}{2}}$$

Likewise, for run No 2 where the field in region G has been changed from $U_{G1}$ to $U_{G2}$, we can say $$\Delta t_{AB2} = \left\{\frac{d_G{*}k^{\frac{1}{2}}{*}m_B^{\frac{1}{2}}}{2^{\frac{1}{2}}} / \left(\frac{m_B{*}UO{*}g_p}{m_{PB}} - U_{G2}{*}g_B\right)^{\frac{1}{2}}\right\} - d_G\left(\frac{{*}k{*}m_{PA}}{2{*}UO{*}g_p}\right)^{\frac{1}{2}} \quad (17)$$

$\Delta t_{AB1}$ and $\Delta t_{AB2}$ are among the delta times measured experimentally for run No. 1 and run No. 2. Furthermore, $\Delta t_{AB1}$ and $\Delta t_{AB2}$ are known to be due to the same principal ion
precursor to daughter fragment product reaction. The two delta times are used in a ratio to simplify calculations. First, simplify equation 16 by factoring out $d_G{*}k^{\frac{1}{2}}/2^{\frac{1}{2}}$:

$$\Delta t_{AB1} = \left(\frac{d_G{*}k^{\frac{1}{2}}}{2^{\frac{1}{2}}}\right){*}\left\{\frac{m_B^{\frac{1}{2}}}{\left[\frac{m_B{*}UO{*}q_p}{m_{PB}} - U_{G1}{*}q_B\right]^{\frac{1}{2}}} - \frac{m_{PA}^{\frac{1}{2}}}{UO^{\frac{1}{2}}{*}p_q^{\frac{1}{2}}}\right\} \quad (18)$$

Now multiply $U_{G1}{*}g_B$ by $(U0{*}g_p)^{\frac{1}{2}}$ to give:

$$\Delta t_{AB1} = \left(\frac{d_G{*}k^{\frac{1}{2}}}{2^{\frac{1}{2}}}\right){*}\left\{\frac{m_B^{\frac{1}{2}}}{\left[\frac{m_B{*}UO{*}q_p}{m_{PB}} - U_{G1}{*}q_B{*}\frac{UO{*}q_p}{UO{*}q_p}\right]^{\frac{1}{2}}} - \left(\frac{m_{PA}}{UO{*}q_p}\right)^{\frac{1}{2}}\right\} \quad (19)$$

and factor $U0{*}G_p$ out as well as define $$\frac{U_{G1}{*}q_B}{UO{*}q_p}$$

as G1. Thus $$\Delta t_{AB1} = \left(\frac{d_G{*}k^{\frac{1}{2}}}{2^{\frac{1}{2}}\,(UO{*}q_p)^{\frac{1}{2}}}\right){*}\left\{\frac{m_B^{\frac{1}{2}}}{\left[\frac{m_B}{m_{PB}} - G1\right]^{\frac{1}{2}}} - m_{PA}^{\frac{1}{2}}\right\} \quad (20)$$

and rearranging gives $$\Delta t_{AB1} = \left(\frac{d_G{*}k^{\frac{1}{2}}}{2^{\frac{1}{2}}UO^{\frac{1}{2}}{*}q_p^{\frac{1}{2}}}\right){*}\left\{\frac{1}{\left[\frac{m_B}{m_{PB}{*}m_B} - \frac{G1}{m_B}\right]^{\frac{1}{2}}} - m_{PA}^{\frac{1}{2}}\right\} \quad (21)$$

Multiplying the right side of equation 21 by $$\frac{m_{PB}^{\frac{1}{2}}}{m_{PB}^{\frac{1}{2}}}$$

$$\Delta t_{AB1} = \left(\frac{d_G{*}k^{\frac{1}{2}}{*}m_{PB}^{\frac{1}{2}}}{2^{\frac{1}{2}}{*}UO^{\frac{1}{2}}{*}q_p^{\frac{1}{2}}}\right){*}\left\{\frac{1}{\left[\frac{m_{PB}{*}m_B}{m_{PB}{*}m_B} - \frac{m_{PB}{*}G1}{m_B}\right]^{\frac{1}{2}}} - \frac{m_{PA}^{\frac{1}{2}}}{m_{PB}^{\frac{1}{2}}}\right\} \quad (22)$$

Defining $m_B/m_{PB}$ as equal to KR will be useful later and by definition $m_{PB}^{\frac{1}{2}} = m_{PA}^{\frac{1}{2}}$ since a common precursor is presumed for the measurement. Thus we find:

$$\Delta t_{AB1} = \left(\frac{d_G{*}k^{\frac{1}{2}}{*}m_{PB}^{\frac{1}{2}}}{2^{\frac{1}{2}}{*}UO^{\frac{1}{2}}{*}q_p^{\frac{1}{2}}}\right){*}\left\{\frac{1}{\left(1 - \frac{G1}{KR}\right)^{\frac{1}{2}}} - 1\right\} \quad (23)$$

Likewise, it can be shown for run No. 2 that:

$$\Delta t_{AB2} = \left(\frac{d_G{*}k^{\frac{1}{2}}{*}m_{PB}^{\frac{1}{2}}}{2^{\frac{1}{2}}{*}UO^{\frac{1}{2}}{*}q_p^{\frac{1}{2}}}\right){*}\left\{\frac{1}{\left(1 - \frac{G2}{KR}\right)^{\frac{1}{2}}} - 1\right\} \quad (24)$$

Since $\Delta t_{AB1}$ and $\Delta t_{AB2}$ are measured and G1 and G2 are known, we know the values for all the variables in equations 24 and 25 except for KR. In finding KR, it is useful to use the ratio $\Delta t_{AB1}$ to $\Delta t_{AB2}$. Thus:

$$\frac{\Delta t_{AB1}}{\Delta t_{AB2}} = \frac{\left(\frac{d_G{*}k^{\frac{1}{2}}{*}m_{PB}^{\frac{1}{2}}}{2^{\frac{1}{2}}{*}UO^{\frac{1}{2}}{*}q_p^{\frac{1}{2}}}\right){*}\left\{\frac{1}{\left(1 - \frac{G1}{KR}\right)^{\frac{1}{2}}} - 1\right\}}{\left(\frac{d_G{*}k^{\frac{1}{2}}{*}m_{PB}^{\frac{1}{2}}}{2^{\frac{1}{2}}{*}UO^{\frac{1}{2}}{*}q_p^{\frac{1}{2}}}\right){*}\left\{\frac{1}{\left(1 - \frac{G2}{KR}\right)^{\frac{1}{2}}} - 1\right\}} \quad (25)$$

or in simplifying $$\frac{\Delta t_{AB1}}{\Delta t_{AB2}} = \frac{\left\{\frac{1}{\left(1 - \frac{G1}{KR}\right)^{\frac{1}{2}}} - 1\right\}}{\left\{\frac{1}{\left(1 - \frac{G2}{KR}\right)^{\frac{1}{2}}} - 1\right\}} \quad (26)$$

From equation 26, KR can be determined and then $m_{PB}/g_{PB}$ can be found from equations 23 or 24 since every other value is either known from basic definitions (i.e., k, $\sqrt{2}$) or determined experimentally (i.e., $\Delta t_{AB1}$, $d_G$, Uo, G1, and G2).

In the actual experiments, the parameters are determined by running specimens giving known principal ion precursors with daughter on and daughter neutral products thus permitting calibration of the experimental parameters without resorting to actual parameter measurements. Thus, we have determined the mass of the precursor and the mass of the ion fragment through the KR definition. The mass of the neutral fragment can now be determined as the mass difference between the precursor and the ion fragment. It should be noted that these mass assignments can now be related to the starting data where the exclusive pairs were found. Furthermore, the pairs having a common precursor can be compared for exclusivity in appearance in the original data thus permitting the same mass precursor to actually be two different elemental structures which can be found by making the exclusivity tests.

Figure 4:
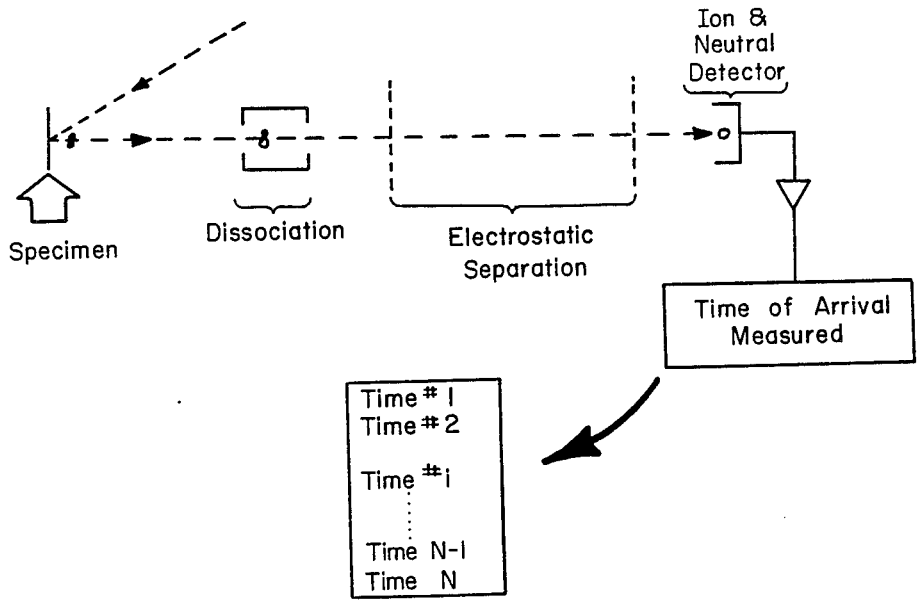
FIG. 4 is an illustration of a data collection method for the present invention wherein the data is continuously gathered.

FIG. 4 illustrates an alternative embodiment of the general flow of information to a data file, which data file stores all times of arrival with the times for the entire experiment linked together. In this case, software determined which times are associated and no null or PLT time is needed for the hardware. Thus, except for the dead time of the hardware not detecting very closely spaced arrivals, all particles are detected and times of arrival stored. In this case, N would typically be a very large number of the order of 1,000,000.

As an example comparison of the enhanced information gathering capability of the present mass spectrometer system may be compared with a conventional mass spectrometer; a MS/MS mass spectrometer having a precursor of 15; and, a MS/MS mass spectrometer having a precuror of 13. A hypothetical specimen containing two compounds X and Y and containing five different functional groups A, B, C, D and E which have masses 1, 2, 3, 4 and 5 respectively will be used as an example. As shown in Table 1, compound X has the structure $A_1$—$B_2$—$C_3$—$D_4$—E and allowed fragment sites of 1, 2, 3 or 4. The total mass of the sample ion X is 15. Compound Y as shown in Table 1 has the structure

TABLE 1

Components of Sample for Illustration in FIG. 5.

| Compound | Structure Fragment-Mass | Allowed Fragment Sites | Parent Mass | Total Sample Ions Produced |
|---|---|---|---|---|
| | A = 1 | | | |
| | B = 2 | | | |
| | C = 3 | | | |
| | D = 4 | | | |
| | E = 5 | | | |
| X | $A_1$—$B_2$—$C_3$—$D_4$—E | 1, 2, 3, or 4 | 15 | 9 |
| Y | $B_1$—$D_2$—$C_3$—D | 1, 2, or 3 | 13 | 7 |

and has allowed fragment sites of 1, 2 and 3.

TABLE 1

Components of Sample for Illustration in FIG. 5.

| Compound | Structure Fragment-Mass | Allowed Fragment Sites | Parent Mass | Total Sample Ions Produced |
|---|---|---|---|---|
| | A = 1 | | | |
| | B = 2 | | | |
| | C = 3 | | | |
| | D = 4 | | | |
| | E = 5 | | | |
| X | $A_1$—$B_2$—$C_3$—$D_4$—E | 1, 2, 3, or 4 | 15 | 9 |
| Y | $B_1$—$D_2$—$C_3$—D | 1, 2, or 3 | 13 | 7 |

The total mass of the sample ion Y is 13. As shown in FIG. 5*a*, the present invention was able to distinguish 16 unique sample and fragment mass assignments spread amongst the 14 observed masses from zero to fifteen. Also as shown, the present invention was able to distinguish between the individual compounds X or Y and the fragment sites. For the same two compounds, the conventional mass spectrometer was able to determine fourteen masses, however, the masses were observed all together without individual mass assignments. Likewise, with the MS/MS mass spectrometer at precursor 15, as shown in FIG. 5*c* , and the MS/MS mass spectrometer with precursor 13, shown in FIG. 5*d*. As can be shown from this example, the present invention is able to obtain exclusive data for each compound and fragment site. The present invention is capable of detecting and measuring with respect to mass simultaneously the ions accelerated from the ion source and their fragments of ion and neutral particles. As illustrated in FIGS. 5*a–d*, the present invention is able to determine the structural composition of complex compounds without the confusion present in ordinary mass spectrometry or in MS/MS where only the sum result of the permutations of many events is observed and where much of the ion signal emanating from the ion source is lost within the chamber of the instrumentation without ever being detected. With the high level of information resolution obtainable with the present invention, it becomes especially enhanced to the determination of the location of functional groupings on complex compounds and to the determination of sequences of specific moieties in complex compounds such as in the sequencing of amino acids in peptides or like biochemical substances.

The present apparatus and method has significant structural and operational benefits over existing mass spectrometry methods and apparatus. For example, with the present apparatus, the average ion current production rate can be adjusted so that the daughter fragment particles which were created from the same ionizing event will all arrive at the detector within a preset time range. These preset time ranges can be distinctly set apart from one another by a null or dead space. This mode of operation relieves some of the burden placed upon the detection intelligence in searching for differences in arrival times in correlating these arrival times with a particular sample mass ionizing event. This is extremely important when considering that for each particular electrostatic G field setting on the order of a million ionizing events and subsequent particle detection thereof may take place to allow for statistically accurate correlations between delta times and the precursor ion sample. Without some method of separating fragments originating from a particular ionizing event at the detector the processing means would have added computational burden. However it should be noted that it is not necessary for the null or dead times to be added since typical detection and processing means when used with the present invention are capable of ultimately correlating the data. Another method of relieving some of the data handling and processing burden of the present system is to position a charged particle deflector at the entrance to the detector. When the deflector is activated the charged particles are deflected from the path of the neutral particles. Thus, when the electrostatic field region is set to decelerate the ions to effect separation between the ions and neutrals originating from the same sample precursor, the detector can be set to be activated by only neutrals and it will then be known with high probability that trailing particles are from the same precursor. This also relieves some of the computational burden of the processing system. In another embodiment the detector is composed of two components one for detecting only neutral particles and/or ion particles depending upon the placement of the charged particle deflector in front of the detector and the other component of the detector only collecting charged particles which are deflected into it just prior to entering the neutral particle detector such as with a Daly detector wherein the ionized particles are captured and measured by the Daly detector but the neutral particles are passed through the detector and activate the neutral particle detector. This two component detector again relieves some of the burden from the required detection intelligence and the data processing and handling system by allowing it to know ahead of time which times of arrival are due to charged particles and which are due to neutral particles. Also when a two component detector is employed the charged particles may be reflected from the path of the neutral particles. This reflection compensates for the velocity spread of high energy ion particles. In this case the ion particle detector is situated close to the path of the neutral and ion components and is generally facing the neutral particle detector. There are various other means for detecting particles of different energy for which this information could be passed to and utilized by the processor. As stated earlier herein the present invention operates to determine the time of arrival of ions and neutrals and to determine the masses of such particles without the requirement for knowledge of the time of ion creation in the ion source or for the need of bunching of the ions anywhere in the device thus allowing the ions to be created in a random manner. With the present invention the ultimate in mass resolution is obtainable in time of flight measurements due to the present concept of utilizing only single ions to be measured and the emphasis placed upon measuring differences in flight times for ions created at the exact same time. Also the ultimate in accuracy of quantification is obtained since the number of unique events can be measured exactly. The present invention can be constructed with less cost and complexity in the instrumentation because no magnets are employed, no pulsing of voltages is required, no r-f fields are employed, and no scanning of any voltage or magnetic fields is required. It will be recognized that with the present invention the ultimate in high mass can be achieved because the requirement for dynamic range is removed and only the time of arrival is needed thus allowing the detector to be designed to be especially effective for high mass, slow moving ions of complex formulations. The concern for dead time is also relieved for the detector since particles arriving from the same event are expected to be of widely differing masses. This frees the design optimization for high mass formulation with emphasis only on the time of arrival of single particles. With the present invention complete recall can be made if each individual particle detected and the unique precursor daughter and/or unique ion-neutral relationship and/or unique simultaneous desorption of other particles from the sample specimen. The present invention represents an entirely new concept in determining structural composition. The concept is vastly superior in exactness and completeness of information gathering and is more simple in its instrumental requirements that previous instrumentation, especially when compared to mass spectrometry to which it is most similar. However it is expected this invention will allow scientists to think in terms of molecular structures and molecular decompositions directly rather than be concerned with the morass entailed with mass spectra.

The present invention provides apparatus and methods for characterizing compounds of high molecular weight. The characterization provides information which is beyond capabilities of ordinary mass spectrometers as well as mass spectrometer-mass spectrometer combinations in sensitivity, ability to work with mixtures, mass range, and in the total information gathered. The ultimate in sensitivity is achieved in that theoretically every particle desorbed as an ion is detected as well as fragment particles from the same ion, thus giving mass as well as structural information of this composition. The ultimate in quantification is also achieved in that all the ions produced by the ion source are counted individually so that uncertainty is theoretically limited only by counting statistics. The invention provides the information without the requirement for building of a mass spectrum although the spectrum can be constructed if desired.

The invention changes the concept of mass spectrometry in general and time-of-flight mass spectrometry especially from a tool that looks at the results of permutation of many different possible events to a concept where the results of each individual ion creation event and each individual ion fragmentation event is measured and stored separately without even requiring knowledge of the time of creation or for the bunching of the ion pulses. The invention is especially applicable to characterization of compounds where fragmentation of the compound tends to occur at selected sites where entire functional groups or repetitive units remain generally intact after the fragmentation. An example is in the sequencing of amino acids in peptides or other substances where sequencing is of interest.

Although the embodiments of the invention have been illustrated and described herein, it is realized that many modifications and changes will be apparent to those skilled in the art. This is especially true since this invention represents a whole new type of analytical tool where many nuances to promote its operation will be attempted. It is thus understood that the appended claims are intended to cover all such modifications and changes as fall within the scope of this invention.

What is claimed is:

1. An apparatus for characterizing the mass of sample and daughter particles, comprising:

a source for providing sample ions;

a fragmentation region wherein a fraction of the sample ions may fragment to produce daughter particles;

an electrostatic field region held at a voltage level G1 to effect ion-neutral separation of fragments from the same sample ion and to separate ions of different kinetic energy;

a detector system for measuring the relative arrival time of particles;

processing means operatively connected to said detector system to receive and store said relative arrival times and operable to compare said arrival times with times detected at the detector when said electrostatic field region is held at a voltage level G2 and to thereafter characterize said particles.

2. The apparatus of claim 1 wherein said processing means includes timing control means operable to control production of sample ions and subsequent detection of said fragments, said timing means effectively separating at the detector the arrival of particles produced from separate ionizing events.

3. The apparatus of claim 2 wherein said processing means further includes voltage supply means for controlling the voltage levels associated with said electrostatic field region.

4. The apparatus of claim 3 further comprising an accelerator means disposed between the sample ion source and fragmentation region to provide said sample ions with a substantially constant relationship between mass and velocity.

5. The apparatus of claim 4 further comprising a drift region disposed between said accelerator means and said fragmentation region, said drift region being of sufficient length to allow sample ions of different mass to achieve a desired separation in time commensurate with ultimate time differences before reaching the fragmentation region.

6. The apparatus of claim 5 wherein said electrostatic field region is held at a voltage potential G1 to accelerate ions.

7. The apparatus of claim 6 wherein said detector input is held at the same electrostatic field level as the level of the electrostatic field region.

8. The apparatus of claim 6 wherein said particle detector is composed of two components, a first component which detects only neutral particles and a second component which detects only charged particles which are deflected therein prior to entering the neutral particle detector.

9. The apparatus of claim 6 wherein the ion particle detector is disposed sufficiently close to the path of the neutral and ion components and facing the neutral particle detector such that when the charged ion particles are reflected velocity spread compensation is effected.

10. The apparatus of claim 6 further including an electrostatic field region having a voltage level different than G1 and G2 disposed at the entrance to said detector, said region acting as an input buffer for the detector system.

11. The apparatus of claim 5 wherein said electrostatic field region is held at a voltage potential G1 to decelerate ions.

12. The apparatus of claim 11 wherein said detector input is held at the same electrostatic field level as the level of the electrostatic field region.

13. The apparatus of claim 11 wherein said particle detector is composed of two components, a first component which detects only neutral particles and a second component which detects only charged particles which are deflected therein prior to entering the neutral particle detector.

14. The apparatus of claim 11 wherein the ion particle detector is disposed sufficiently close to the path of the neutral and ion components and facing the neutral particle detector such that when the charged ion particles are reflected velocity spread compensation is effected.

15. The apparatus of claim 11 further comprising a drift region disposed between said accelerator means and said fragmentation region, said drift region being of sufficient length to allow sample ions of different mass to achieve a desired separation in time commensurate with ultimate time differences before reaching the fragmentation region.

16. The apparatus of claim 11 wherein a charged particle deflector is disposed at the entrance to the detector system, said particle deflector operating in response to a control signal from said processing means to activate and deactivate said deflector to deflect charged particles from the path of said neutrals, said deflector activation allowing the detector to be activated only by a neutral particle followed by deflector deactivation allowing the detector to be activated by trailing ionic or neutral particles.

17. A mass spectrometer comprising a source of sample ions, an ion accelerator for accelerating said sample ions to provide sample ions having a substantially constant relationship between mass and velocity, said accelerated ions being allowed to drift a distance sufficient to achieve a desired separation in time between ions of different mass, a fragmentation region adapted to receive said sample ions and to induce a significant portion of said sample ions to fragment into neutral and ion daughter fragments, a first electrostatic field region adapted to effect separation between neutral and ion fragments originating from the same sample ion and to effect separation between ions of different kinetic energy, and a detector system to measure relative arrival times of said particles;

a second electrostatic field region disposed between said first electrostatic region and said detector and having a voltage setting to allow said fragmented particles to be detected without having said first electrostatic field affect the electrostatic requirements of the detector; and means for comparing the detected relative arrival times obtained when said first electrostatic field region has a potential setting G1 with detected arrival times when said first electrostatic field region has a potential setting G2 and for determining masses of said particles based upon said relative arrival times and said electrostatic field settings.

18. A mass spectrometer in accordance with claim 17 wherein said fragmentation region comprises a drift region facilitating metastable decomposition.

19. A mass spectrometer in accordance with claim 17 wherein said fragmentation region comprises a collision chamber.

20. A mass spectrometer in accordance with claim 17 wherein said fragmentation region comprises a means for injecting energy into the sample ion.

21. A mass spectrometer in accordance with claim 20 wherein said means comprises a laser beam to cause fragmentation of the sample ions.

22. A mass spectrometer in accordance with claim 19 wherein said accelerator means provides sample ions having substantially equal kinetic energy.

23. A mass spectrometer in accordance with claim 17 wherein said accelerator means provides sample ions having substantially equal momentum.

24. The means of claim 17 wherein said ion source is a field desorption source operated without pulsing.

25. The means of claim 17 wherein said ion source is a projectile bombardment ion source operated at very low bombardment rates.

26. A mass spectrometry method for determining relationships between sample ions and daughter particles produced by fragmentation, said method comprising the steps of:

(a) providing sample ions, (b) accelerating said sample ions, (c) facilitating fragmentation of a fraction of said accelerated sample ions without substantial change in velocity to produce daughter particles, (d) directing the daughter particles and any unfragmented sample ions through an electrostatic G field region to effect ion-neutral separation, (e) detecting ions subsequent to passage through the electrostatic G field and subsequent to separation in time, (f) altering the G field setting of the electrostatic field and repeating steps (a) through (e), (g) determining a relationship between the sample and daughter particles based on the time separation values and the varied G field setting.

27. A mass spectrometry method in accordance with claim 26 wherein said electrostatic G field is an ion accelerating field.

28. A mass spectrometry method in accordance with claim 26 wherein said electrostatic G field is an ion decelerating field.

29. A detector system for a conventional mass spectrometer having a continuous beam output, comprising an acceleration means for accelerating said continuous beam output ions to provide said ions with a substantially constant relationship between mass and velocity, a fragmentation region wherein substantially all the ions present in said ion beam may fragment to produce daughter ions, an electrostatic field region held at a voltage level G1 to effect ion-neutral separation and to separate ions of different kinetic energy, a detector for measuring the relative arrival time of said particles and processing means operatively connected to said detector to receive and store said relative arrival times and operable to thereafter characterize said particles with respect to mass, said system increasing the informing power capabilities of said conventional mass spectrometer by further mass resolving said continuous beam output into accurate mass fractions.

* * * * *

UNITED STATES PATENT AND TRADEMARK OFFICE

CERTIFICATE OF CORRECTION

PATENT NO. : 4,818,862

DATED : April 4, 1989

INVENTOR(S) : Robert J. Conzemius

It is certified that error appears in the above—identified patent and that said Letters Patent is hereby corrected as shown below:

Column 1, line 6, before "invention" insert --This--.

Column 8, line 60, $KE=(\frac{1}{2})*m_p*v_p$ (1)

should be $KE = (1/2)*m_p*v_p^2$ (1)

Column 9, line 1, $KE = UO*q_p = \frac{k}{2}*m_p*v_p^2$ (2)

should be $KE = UO*q_p = \frac{k}{2}*m_p*v_p^2$ (2)

Column 9, line 18, $m_{B1}$ should be $m_{BI}$

Column 9, line 20, $v_p=v_{AN}=v_{B1}$ (3)

should be $v_p = v_{AN} = v_{BI}$ (3)

Column 10, line 40, $mPB$ should be $m_{PB}$

Column 10, line 41, $=mp)$ should be $= m_p)$

Column 11, line 36, $(U0*g_p)^{\frac{1}{2}}$ should be $(UO*q_p/UO*q_p)^{1/2}$

UNITED STATES PATENT AND TRADEMARK OFFICE

CERTIFICATE OF CORRECTION

PATENT NO. : 4,818,862

DATED : April 4, 1989

INVENTOR(S) : Robert J. Conzemius

It is certified that error appears in the above—identified patent and that said Letters Patent is hereby corrected as shown below:

Column 11, line 47, $UO*G_p$ should be $UO*q_p$

Column 11, line 56, $$\Delta t_{AB1} = \left(\frac{d_G * k^{\frac{1}{2}}}{2^{\frac{1}{2}} (UO*q_p)^{\frac{1}{2}}}\right) * \left\{ \frac{m_B^{\frac{1}{2}}}{\left[\frac{m_B}{m_{PB}} - G1\right]^{\frac{1}{2}}} - m_{PA}^{\frac{1}{2}} \right\} \quad (20)$$

should be $$\Delta t_{AB1} = \left(\frac{d_G * k^{1/2}}{2^{1/2} (UO*q_p)^{1/2}}\right) * \left\{ \frac{m_B^{1/2}}{\left[\frac{m_B}{m_{PB}} - G1\right]^{1/2}} - m_{PA}^{1/2} \right\} \quad (20)$$

Column 11, line 65, $$\Delta t_{AB1} = \left(\frac{d_G * k^{\frac{1}{2}}}{2^{\frac{1}{2}} UO^{\frac{1}{2}} * q_p^{\frac{1}{2}}}\right) * \left\{ \frac{1}{\left[\frac{m_B}{m_{PB} * m_B} - \frac{G1}{m_B}\right]^{\frac{1}{2}}} - m_{PA}^{\frac{1}{2}} \right\} \quad (21)$$

should be $$\Delta t_{AB1} = \left(\frac{d_G * k^{1/2}}{2^{1/2} UO^{1/2} * q_p^{1/2}}\right) * \left\{ \frac{1}{\left[\frac{m_B}{m_{PB} * m_B} - \frac{G1}{m_B}\right]^{1/2}} - m_{PA}^{1/2} \right\} \quad (21)$$

Column 12, line 5, $\frac{m_{PB}^{\frac{1}{2}}}{m_{PB}^{\frac{1}{2}}}$ should be $\frac{m_{PB}^{1/2}}{m_{PB}^{1/2}}$

UNITED STATES PATENT AND TRADEMARK OFFICE

CERTIFICATE OF CORRECTION

PATENT NO. : 4,818,862

DATED : April 4, 1989

INVENTOR(S) : Robert J. Conzemius

It is certified that error appears in the above—identified patent and that said Letters Patent is hereby corrected as shown below:

Column 12, line 10, $$\Delta t_{AB1} = \left(\frac{d_G * k^{1/2} * m_{PB}^{1/2}}{2^{1/2} * UO^{1/2} * q_p^{1/2}}\right) * \left\{\frac{1}{\left[\frac{m_{PB} * m_B}{m_{PB} * m_B} - \frac{m_{PB} * G1}{m_B}\right]^{1/2}} - \frac{m_{PA}^{1/2}}{m_{PB}^{1/2}}\right\} \quad (22)$$

should be $$\Delta t_{AB1} = \left(\frac{d_G * k^{1/2} * m_{PB}^{1/2}}{2^{1/2} * UO^{1/2} * q_p^{1/2}}\right) * \left\{\frac{1}{\left[\frac{m_{PB} * m_B}{m_{PB} * m_B} - \frac{m_{PB} * G1}{m_B}\right]^{1/2}} - \frac{m_{PA}^{1/2}}{m_{PB}^{1/2}}\right\} \quad (22)$$

Column 12, line 17, $m_{PB}^{1/2} = m_{PA}^{1/2}$ should be $m_{PB}^{1/2} = m_{PA}^{1/2}$ Column 12, line 21, $$\Delta t_{AB1} = \left(\frac{d_G * k^{1/2} * m_{PB}^{1/2}}{2^{1/2} * UO^{1/2} * q_p^{1/2}}\right) * \left\{\frac{1}{\left(1 - \frac{G1}{KR}\right)^{1/2}} - 1\right\} \quad (23)$$

should be $$\Delta t_{AB1} = \left(\frac{d_G * k^{1/2} * m_{PB}^{1/2}}{2^{1/2} * UO^{1/2} * q_p^{1/2}}\right) * \left\{\frac{1}{\left(1 - \frac{G1}{KR}\right)^{1/2}} - 1\right\} \quad (23)$$

Column 12, line 30, $$\Delta t_{AB2} = \left(\frac{d_G * k^{1/2} * m_{PB}^{1/2}}{2^{1/2} * UO^{1/2} * q_p^{1/2}}\right) * \left\{\frac{1}{\left(1 - \frac{G2}{KR}\right)^{1/2}} - 1\right\} \quad (24)$$

should be $$\Delta t_{AB2} = \left(\frac{d_G * k^{1/2} * m_{PB}^{1/2}}{2^{1/2} * UO^{1/2} * q_p^{1/2}}\right) * \left\{\frac{1}{\left(1 - \frac{G2}{KR}\right)^{1/2}} - 1\right\} \quad (24)$$

CERTIFICATE OF CORRECTION

PATENT NO. : 4,818,862

DATED : April 4, 1989

INVENTOR(S) : Robert J. Conzemius

It is certified that error appears in the above—identified patent and that said Letters Patent is hereby corrected as shown below:

Column 12, line 40, $$\frac{\Delta t_{AB1}}{\Delta t_{AB2}} = \frac{\left(\frac{d_G * k^{\frac{1}{2}} * m_{PB}^{\frac{1}{2}}}{2^{\frac{1}{2}} * UO^{\frac{1}{2}} * q_p^{\frac{1}{2}}}\right) \cdot \left\{\frac{1}{\left(1 - \frac{G1}{KR}\right)^{\frac{1}{2}}} - 1\right\}}{\left(\frac{d_G * k^{\frac{1}{2}} * m_{PB}^{\frac{1}{2}}}{2^{\frac{1}{2}} * UO^{\frac{1}{2}} * q_p^{\frac{1}{2}}}\right) \cdot \left\{\frac{1}{\left(1 - \frac{G2}{KR}\right)^{\frac{1}{2}}} - 1\right\}} \quad (25)$$

should be $$\frac{\Delta t_{AB1}}{\Delta t_{AB2}} = \frac{\left(\frac{d_G * k^{1/2} * m_{PB}^{1/2}}{2^{1/2} * UO^{1/2} * q_p^{1/2}}\right) * \left\{\frac{1}{\left(1 - \frac{G1}{KR}\right)^{1/2}} - 1\right\}}{\left(\frac{d_G * k^{1/2} * m_{PB}^{1/2}}{2^{1/2} * UO^{1/2} * q_p^{1/2}}\right) * \left\{\frac{1}{\left(1 - \frac{G2}{KR}\right)^{1/2}} - 1\right\}} \quad (25)$$

Column 12, line 66, Uo should be UO

Column 13, line 31, precuror should be precursor

Column 13, line 36, $A_1—B_2—C_3—D_4—E$ should be $A_1-B_2-C_3-D_4-E$

Column 13, line 39, after "ture" insert $B_1-D_2-C_3-D$

Column 13, line 50, $A_1—B_2—C_3—D_4—E$ should be $A_1-B_2-C_3-D_4-E$

UNITED STATES PATENT AND TRADEMARK OFFICE

CERTIFICATE OF CORRECTION

PATENT NO. : 4,818,862

DATED : April 4, 1989

INVENTOR(S) : Robert J. Conzemius

It is certified that error appears in the above—identified patent and that said Letters Patent is hereby corrected as shown below:

Column 13, line 51, $B_1-D_2-C_3-D$ should be $B_1-D_2-C_3-D$

Column 13, lines 54-65, delete (duplicate of lines 40-51)

Signed and Sealed this

Third Day of April, 1990

*Attest:*

HARRY F. MANBECK, JR.

*Attesting Officer*

*Commissioner of Patents and Trademarks*